US011877675B2

(12) United States Patent
Kissling

(10) Patent No.: US 11,877,675 B2
(45) Date of Patent: Jan. 23, 2024

(54) SUPPORT ELEMENT FOR A TIMEPIECE, SUCH AS A WRISTWATCH, OR A PIECE OF JEWELLERY

(71) Applicant: OMEGA SA, Biel/Bienne (CH)

(72) Inventor: Gregory Kissling, La Neuveville (CH)

(73) Assignee: OMEGA SA, Biel/Bienne (CH)

( * ) Notice: Subject to any disclaimer, the term of this patent is extended or adjusted under 35 U.S.C. 154(b) by 0 days.

(21) Appl. No.: 17/388,681

(22) Filed: Jul. 29, 2021

(65) Prior Publication Data

US 2022/0087449 A1 Mar. 24, 2022

(30) Foreign Application Priority Data

Sep. 22, 2020 (EP) ..... 20197406

(51) Int. Cl.
*A47F 7/03* (2006.01)
*A45C 11/10* (2006.01)
*A45C 11/16* (2006.01)

(52) U.S. Cl.
CPC ..... *A47F 7/03* (2013.01); *A45C 11/10* (2013.01); *A45C 11/16* (2013.01)

(58) Field of Classification Search
CPC ..... A47F 7/03; A45C 11/10; A45C 11/16
USPC ..... 206/764
See application file for complete search history.

(56) References Cited

U.S. PATENT DOCUMENTS

| | | | | |
|---|---|---|---|---|
| 7,992,830 | B2 | 8/2011 | Wenger | |
| 2014/0061090 | A1 | 3/2014 | Amaral | |
| 2017/0238665 | A1* | 8/2017 | Phipps | A45C 11/12 |
| 2019/0281937 | A1 | 9/2019 | Kissling | |

FOREIGN PATENT DOCUMENTS

| | | | |
|---|---|---|---|
| CN | 106659274 | A | 5/2017 |
| DE | 198 18 100 | A1 | 10/1999 |
| JP | 2017-526500 | A | 9/2017 |
| KP | 10-2019-0108055 | | 9/2019 |
| KR | 10-1340783 | | 12/2013 |
| WO | 2011/098853 | A1 | 8/2011 |
| WO | 2011098853 | A1 | 8/2011 |
| WO | 2016/019483 | A1 | 2/2016 |

OTHER PUBLICATIONS

European Search Report for 20 19 7406 dated Feb. 19, 2021.
Notice of Grounds for Rejection in Korean dated Nov. 9, 2023.

* cited by examiner

*Primary Examiner* — Andrew D Perreault
(74) *Attorney, Agent, or Firm* — Sughrue Mion, PLLC

(57) ABSTRACT

A support element (100, 200) for a timepiece (10) or a piece of jewellery including a receiving surface (111) configured to be at least partly in direct contact with the timepiece (10), or piece of jewellery, the support element (100, 200) including a peripheral portion (110) carrying the receiving surface (111), and a central portion (120, 220) formed by a block of material, the support element (100, 200) including an internal cavity (130, 230) forming a recess of the central portion (120, 220); the internal cavity defining a volume configured to receive and hold in position an object (140) inside the support element (100, 200).

16 Claims, 4 Drawing Sheets

SUPPORT ELEMENT FOR A TIMEPIECE, SUCH AS A WRISTWATCH, OR A PIECE OF JEWELLERY

CROSS-REFERENCE TO RELATED APPLICATIONS

This application claims priority to European Patent Application No. 20197406.0 filed Sep. 22, 2020, the entire contents of which are incorporated herein by reference.

TECHNICAL FIELD OF THE INVENTION

The field of the invention relates to the devices for the presentation and protection of objects, in particular timepieces or pieces of jewellery.

The invention relates more particularly to a removable support element, for example for a wristwatch, intended to be integrated into a storage member and/or a display stand.

TECHNOLOGICAL BACKGROUND

It is a known practice to present timepieces or pieces of jewellery in storage members, such as boxes or protective presentation-cases.

Such storage members can take different shapes and generally allow to store and/or transport one or more timepieces. These storage members are conventionally called a display stand, box, protective-case, casing, case, enclosure, holder, pouch, etc.

Thus, in the remainder of the present application, the term storage member will be used to denote either a case, an enclosure, a protective-case, a holder, a box, a display stand, a storage, a pouch, or else any other container intended to receive and protect against impacts, scratches, or else scuffing a timepiece or a piece of jewellery.

The storage members, conventionally used for the protection and transport of timepieces, or pieces of jewellery, are generally of rigid design and may have a flexible, quilted or even velvety internal coating so as to form a protective-case thus avoiding any risk of damage to the object housed inside the storage member.

These storage members generally have at least one compartment configured to allow the positioning of a removable support element intended to receive the timepiece, such as a wristwatch, or the piece of jewellery. These support elements also allow to maintain the timepiece, or the piece of jewellery, in a certain position inside the compartment, and to take care of the presentation of the object in the storage member so that the object is correctly in place when opening the storage member.

These support elements perform a support function but also protect the internal elements of the timepiece, or of the piece of jewellery, against scuffing, scratches and/or impacts.

The support element can be, for example, a sort of removable cushion, also called a watch pillow, or a flexible support having a C-shaped strip or blade adapted to receive a wristwatch or a piece of jewellery.

Some storage members may also include additional compartments sized to receive various accessories, such as for example bracelets, microfiber wipes for cleaning, pieces of jewellery, magnifying devices, etc.

However, these storage members with several compartments are generally large and bulky. Consequently, they are poorly suited to frequent transport, and in particular to travel. Thus, it is common for owners of watches or pieces of jewellery to choose to replace the original storage members and temporarily use other storage members of smaller dimensions, such as a travel case, for their trips or their travels.

These travel cases also allow to transport and ensure the protection of wristwatches, or pieces of jewellery, while offering a small space requirement.

However, given the compactness of these travel cases, it is often not possible to transport anything other than a wristwatch or a piece of jewellery. In fact, the primary objective of such cases is to provide optimised compactness while guaranteeing effective protection against impacts, scratches and scuffing. Thus, these cases, or secondary storage member, are absolutely not intended and sized for the integration of additional accessories.

Thus, the user is forced to choose between the use of a compact case which does not allow the transport of additional accessories, but which has a small space requirement thus facilitating transport and accommodation in luggage, or the use of a storage member which is large, bulky, and impractical to fit into a piece of luggage, wherein he can transport at least one wristwatch, or one piece of jewellery, as well as the accessories that he wishes to transport with him.

To overcome this problem, the user can choose to purchase a new storage member having intermediate dimensions in line with the objects and accessories that he wishes to transport. However, this solution is not entirely satisfactory and is not economically viable for the user who will have to constantly adapt the dimensions of the storage member according to the type and/or the number of accessories that he wishes to take with him.

SUMMARY OF THE INVENTION

In this context, the invention proposes a new support element for a timepiece, in particular a wristwatch, or a piece of jewellery allowing to overcome the disadvantages presented above.

To this end, the invention relates to a support element for a timepiece, or a piece of jewellery, comprising a receiving surface configured to be at least partly in direct contact with said timepiece, or the piece of jewellery, said support element comprising a peripheral portion carrying said receiving surface, and a central portion formed by a block of material, said support element being characterised in that it comprises an internal cavity forming a recess in the central portion; said internal cavity defining a volume configured to receive and hold in position an object inside said support element.

The support element according to the invention allows, in addition to a support function, to be able to integrate and house an object inside the material of the support element. Thus, the modularity of such a support element is optimised by reducing the non-functional portions.

Thus, the support element according to the invention allows to exploit, enhance and use an existing "lost" volume, that is to say without any particular function, located in a central region of the support elements, of the watch pillow type, from the prior art. Such a support element according to the invention exploiting this lost volume thus allows to integrate a useful object for the customer without additional bulk.

Advantageously, the shape of the internal cavity is in line with the object that one wishes to integrate into the support element. Thus, the internal cavity can have different shapes and in particular a section of circular, oval, ovoid, oblong or else polygonal shape, depending on the needs.

According to one embodiment, the central portion comprises at least one region made of cellular material, elastomer or else viscoelastic polymer, said internal cavity being located at said region made of cellular material, elastomer or else viscoelastic polymer. Thus, the material of the internal cavity allows to maintain the object.

According to one embodiment, the central portion comprises at least one region made of polyurethane foam or polyethylene foam, said internal cavity being located at said region made of polyurethane foam or polyethylene foam.

According to one embodiment, the object is retained in said internal cavity by elastic or viscoelastic response of the material after a deformation of the internal cavity.

According to one embodiment, the central portion has a density comprised between 30 and 90 Shore A.

According to one embodiment, the peripheral portion is made of a cellular material, an elastomer or else a viscoelastic polymer. Thus, the material of the peripheral portion provides a soft and deformable contact for the positioning of the timepiece.

According to one embodiment, the peripheral portion and the central portion are formed integrally. Thus, the manufacturing method is simplified.

According to one embodiment, said internal cavity extends on either side of said central portion. Thus, the removal of the object inside the internal cavity is facilitated.

According to one embodiment, said internal cavity defines a volume configured to receive and hold in position a timepiece accessory or a piece of jewellery inside said support element. Thus, it is possible to transport in addition to a timepiece, such as a wristwatch, an additional timepiece accessory or a piece of jewellery that can be integrated into the support element.

According to one embodiment, the timepiece accessory is a magnifying device. Thus, the user can carry a watchmaker's eyeglass easily without additional bulk.

According to one embodiment, said internal cavity has the shape of a counterbore. This shape advantageously allows to integrate a watchmaker's eyeglass and to form a positioning stop.

According to one embodiment, said support element comprises a removal member configured to allow the object to be removed from the internal cavity. Thus, the user has a means allowing to easily remove the object from the internal cavity without risk of damaging the object or the internal cavity of the support element.

According to one embodiment, the central portion comprises at least one removable portion formed at the periphery of said internal cavity, said removable portion being configured to modify the shape and/or the dimensions of said internal cavity upon removal of said removable portion from the central portion. Thus, it is possible to modulate the dimensions and the shape of the internal cavity simply by removing one or more removable portions from the central portion.

According to one embodiment, the support element has a shape adapted to receive a wristwatch at said receiving surface.

The object of the invention is also a member for storing a timepiece, or a piece of jewellery, characterised in that it comprises an external envelope including a movable portion, movable between a closed position and an open position, said open position of the movable element allowing access to an internal compartment formed inside the external envelope; a support element according to the invention removably positioned in said internal compartment.

BRIEF DESCRIPTION OF THE FIGURES

The purposes, advantages and features of the present invention will become apparent upon reading the detailed description below with reference to the following figures.

DETAILED DESCRIPTION OF THE INVENTION

Figure 1:
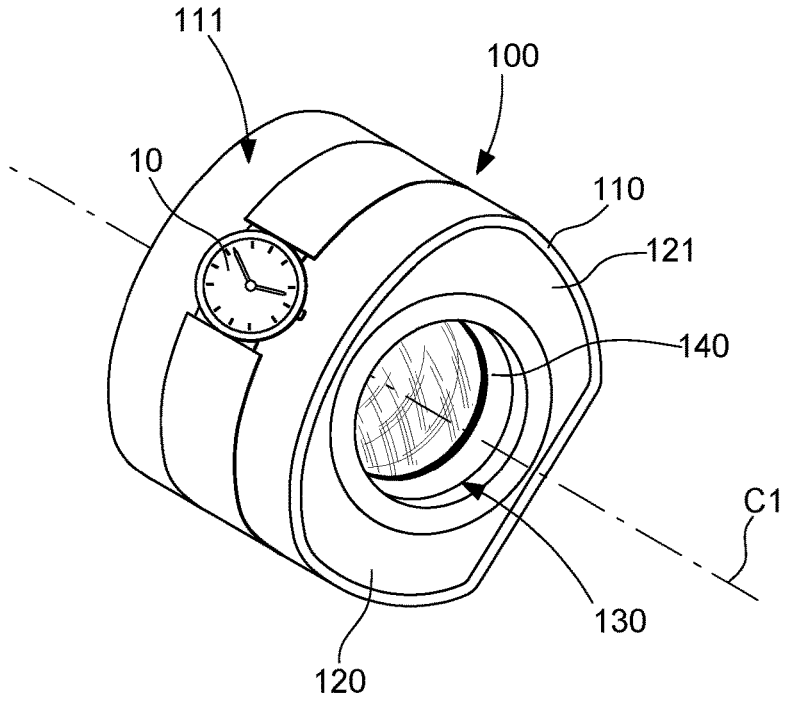
FIG. 1 is a schematic perspective representation of a first exemplary embodiment of a support element according to the invention.

FIG. 1 is a schematic perspective representation of a first exemplary embodiment of a support element 100 according to the invention.

Figure 2:
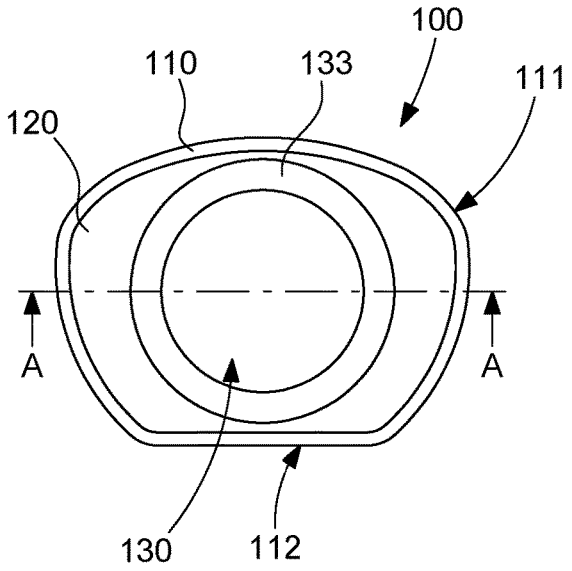
FIG. 2 illustrates a side view of the first exemplary embodiment of the support element illustrated in FIG. 1.

FIG. 2 illustrates a side view of the first embodiment of the support element 100 shown in FIG. 1.

Figure 3:
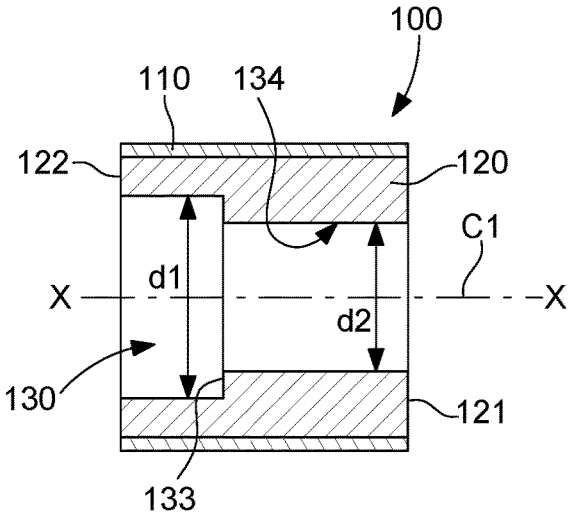
FIG. 3 illustrates a sectional view of the first exemplary embodiment of the support element illustrated in FIG. 1, along the section plane A-A illustrated in FIG. 2.

FIG. 3 illustrates a sectional view of the first exemplary embodiment of the support element 100 illustrated in FIG. 1, along the section plane A-A illustrated in FIG. 2.

The support element 100 has a general shape adapted for the positioning and mounting of a timepiece 10, such as a wristwatch and/or a piece of jewellery (not shown).

Thus, the support element 100 may for example have a cylindrical, ovoid, ellipsoid, shape etc., and may be composed of one or more convex surfaces formed by one or more radii of curvature.

Cylindrical shape means a shape having a ruled surface whose generatrices are parallel, that is to say a surface in space consisting of parallel lines. Thus, a cylindrical shape according to the invention is not necessarily related to a straight cylinder which is a particular shape of a cylinder.

In the first embodiment illustrated in FIGS. 1 to 3, the support element 100 is of the cushion or watch pillow type, having a geometry and dimensions suitable for receiving a timepiece and/or a piece of jewellery, and in particular a wristwatch.

The support element 100 comprises a central portion 120 forming a block of material, as well as a peripheral portion 110 formed at the periphery of the central portion 120, said peripheral portion 110 being removable or integral with the central portion 120.

Preferably, the support element 100 is a block of material including a central portion 120 and a peripheral portion 110.

The peripheral portion 110 has a curved receiving surface 111, essentially convex, intended to be at least partly in direct contact with said timepiece 10, and more particularly with the internal diameter of the bracelet of a wristwatch, and possibly with the back of the casing of the wristwatch, or of the piece of jewellery.

In the exemplary embodiment illustrated in FIGS. 1 to 3, the receiving surface 111 is composed of a plurality of convex surfaces having several radii of curvature.

The peripheral portion 110 may also comprise, as illustrated in FIGS. 1 to 3, a flat lower surface 112 large enough to facilitate holding, and ensure stable maintain of the support element 100.

The support element 100 also has two flanks 121, 122 forming the side faces of the support element 100. The peripheral portion 110, the central portion 120 and the flanks 121, 122 thus define the general volume of the support element 100.

The exemplary embodiment illustrated in FIGS. 1 to 3 shows the flanks 121, 122 of the support element 100 which are substantially planar and parallel to each other so that the support element has a generally cylindrical shape; however, this representation is an exemplary embodiment and is not limiting of the invention. Indeed, the flanks 121, 122 of the support element 100 can have various shapes (for example curved, convex or concave in shape) and be arranged in the same plane or not, symmetrically or not.

The support element 100 according to the invention also has an internal housing, or an internal cavity 130, forming a recess in the central portion 120.

The internal cavity 130 is preferably provided at the central portion 120 of the support element 100.

Preferably, the internal cavity 130 is formed substantially in a central region of the central portion 120.

Preferably, the internal cavity 130 opens out at one of the flanks 121, 122 of the support element 100.

Preferably, the internal cavity 130 opens out at the two flanks 122, 122 of the support element 100, so that the internal cavity 130 traverses the central portion 120 of the support element 100 on either side.

Preferably, the internal cavity 130 extends along an axis X-X substantially parallel to a central axis Cl of the support element 100.

Preferably, the internal cavity 130 extends along an axis X-X coaxial with the central axis Cl of the support element 100.

The internal cavity 130 is dimensioned so as to allow the introduction of an accessory 140 inside the support element 100, as well as its retention inside this internal cavity 130.

The internal cavity 130 has a shape that matches the type of accessory 140 that it is desired to integrate into the support element 100. Thus, the internal cavity 130 can have different shapes and in particular a section of circular, oval, ovoid, oblong, or else polygonal shape, depending on the needs.

Figure 4A:
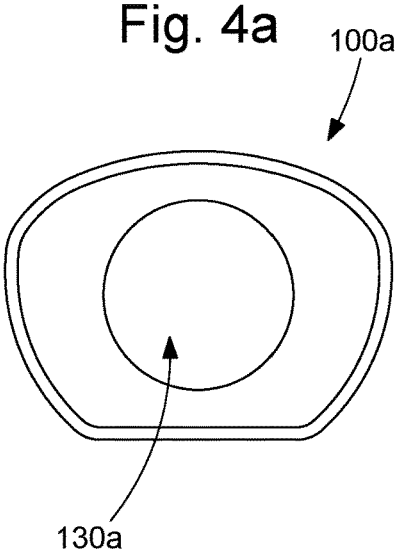
FIG. 4*a* illustrates a side view of a first alternative embodiment of the exemplary embodiment of the support element illustrated in FIG. 1.
Figure 4B:
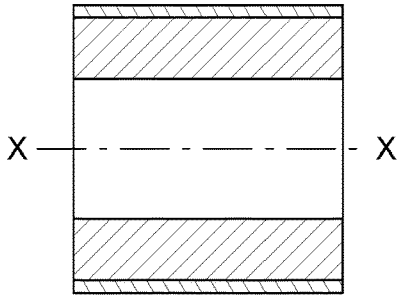
FIG. 4*b* illustrates a sectional view of the first alternative embodiment of the support element illustrated in FIG. 4*a*, along the section plane A-A illustrated in FIG. 2.
Figure 5A:
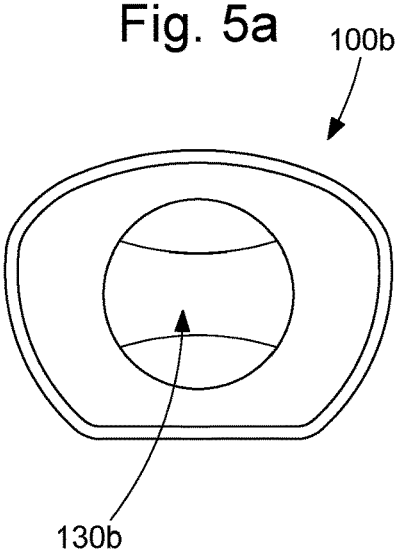
FIG. 5*a* illustrates a side view of a second alternative embodiment of the exemplary embodiment of the support element illustrated in FIG. 1.
Figure 5B:
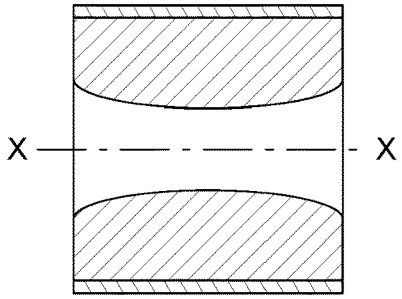
FIG. 5*b* illustrates a sectional view of the second alternative embodiment of the support element illustrated in FIG. 5*a*, along the section plane A-A illustrated in FIG. 2.
Figure 6A:
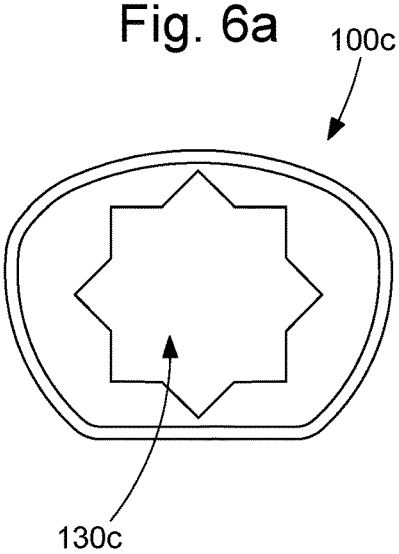
FIG. 6*a* illustrates a side view of a third alternative embodiment of the exemplary embodiment of the support element illustrated in FIG. 1.
Figure 6B:
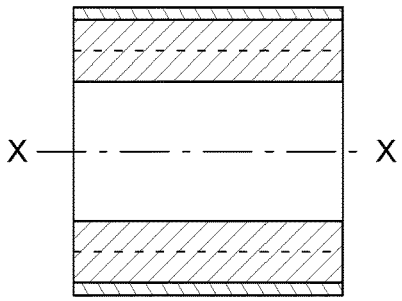
FIG. 6*b* illustrates a sectional view of the third alternative embodiment of the support element illustrated in FIG. 6*a*, along the section plane A-A illustrated in FIG. 2.

FIGS. 4*a*, 5*a* and 6*a* show, in side view, alternative embodiments of the support element 100 illustrated in FIGS. 1 to 3. FIGS. 4*b*, 5*b* and 6*b* show the sectional views of these alternative embodiments along the same section plane A-A illustrated in FIG. 2.

With reference to FIGS. 4*a* and 4*b*, the support element 100*a* according to the invention comprises an internal cavity 130*a* of circular section, and of constant dimension.

With reference to FIGS. 5*a* and 5*b*, the support element 100*b* according to the invention comprises an internal cavity 130*b* having a circular section whose diameter varies along the axis X-X, so that the internal cavity 130*b* has a curved profile of concave shape in the direction of the axis X-X. Such a profile of the internal cavity 130*b* allows, for example, to guarantee the retention of an accessory of small dimensions in the centre of the support element 100 and/or of an accessory of larger dimensions at the ends of the internal cavity 130*b* (that is to say close to the flanks 121, 122).

Such a profile also allows to guarantee a privileged retention of an accessory 140 at the central portion 120 of the internal cavity 130 while facilitating the gripping of the accessory 140 by the user when he wishes to remove it from the internal cavity 130, in particular if the dimensions of the ends of the internal cavity 130 are greater than the dimensions of the ends of the accessory 140.

With reference to FIGS. 6*a* and 6*b*, the support element 100*c* according to the invention comprises an internal cavity 130*c* of polygonal section, for example in the shape of a star. Such a shape allows to provide a versatile housing allowing to position various accessories of different shapes, such as, for example, an accessory of straight cylindrical, spherical, cubic, or else rectangular shape.

Thus, the section of the internal cavity 130 can have variable shapes, as well as variable dimensions depending on the type of accessory 140 that one wishes to integrate into the internal cavity 130 of the support element 100.

In the exemplary embodiment illustrated in FIGS. 2 and 3, the internal cavity 130 has a cylindrical shape composed of two portions of constant sections and of different dimensions so that the internal cavity 130 forms a counterbore. Thus, the internal cavity 130 has a first diameter d1 at one of these ends and a second diameter d2, less than d1, at its other end. The difference in the bore diameter of the internal cavity 130 thus allows to create an annular shoulder 133 inside the internal cavity 130 configured to form a positioning stop for the accessory 140.

Preferably, the dimensions of the internal cavity 130 are slightly smaller than the dimensions of the accessory 140 that it is desired to integrate inside the support element 100, so as to allow retention by friction and/or by elastic or viscoelastic response of the material after a deformation of the latter during the introduction of the accessory 140 into the internal cavity 130.

Retaining the accessory 140 in the internal cavity 130 is for example achieved by rubbing the accessory 140 against at least a portion of the wall 134 of the internal cavity 130.

To improve the retention of the accessory 140 by friction, the wall 134 of the internal cavity 130 can be covered with a coating promoting interaction with the accessory 140, or else have surface irregularities, or else protuberances, such as for example bosses, at the surface of the wall 134 of the internal cavity 130.

The irregularities or protuberances are advantageously made of a material which promotes friction, rubbing or interaction with the accessory 140.

The irregularities or protuberances can be made of a material different from the material used for the production of the central portion 120, and which advantageously has anti-slip properties so as to increase, if necessary, the retention of the accessory 140 inside the internal cavity 130, in particular when handling the support element 100.

The retention of the accessory 40 can also be achieved, in a complementary or independent manner with the example described in the preceding paragraphs, by the application of pressure on the accessory 140 when the latter is in position in the internal cavity 130.

The pressure is exerted on the accessory 140 by elastic or viscoelastic response of the surrounding material due to a slight deformation of the internal cavity 130 after the introduction of the accessory 140, in particular when the dimensions of the internal cavity 130 are slightly smaller than the dimensions of the accessory 140.

To this end, the central portion 120 comprises at least one region made of a flexible material having elastic or viscoelastic properties, the internal cavity 130 being formed in this particular region of the central portion 120.

A flexible material means a material that can easily be deformed manually, having a density comprised between 30 and 90 Shore A.

The flexible material may for example be a cellular material, for example a polymer foam, an elastomer, a viscoelastic polymer.

The flexible material is for example a polyurethane foam or a polyethylene foam.

Preferably, the entire the central portion 120 is made of a flexible material having elastic or viscoelastic properties.

Preferably, the material of the central portion 120 of the support element 100 and the material of the peripheral portion 110 are identical. However, the densities and the hardnesses of these two portions may be different.

According to an alternative embodiment, the material of the peripheral portion 110 is different from the material of the central portion 120. The peripheral portion can thus be made of a material which is more rigid than the central portion and be coated for example with a leather, a fabric or a synthetic material so as to protect the interior portion of the timepiece 10 or the piece of jewellery from scuffing and/or scratches.

The use of an external coating also allows to customise the presentation of the support element 100.

Preferably, the support element 100 is a one-piece element, that is to say that the central portion 120 and the peripheral portion 110 are made in one piece.

The peripheral portion 110 and the central portion 120 can be made from the same material (with different or equivalent properties) or from different materials.

When the central portion has features, for example of hardness and/or density, different from the peripheral portion, the support element can be produced by polymerising or by gluing, the two portions.

According to an alternative embodiment, the central portion 120 and the peripheral portion 110 are two separate parts, that is to say made separately. The central portion 120 and the peripheral portion 110 may have identical or different features and be made from an identical material or not.

Thus, in this alternative embodiment, the support element 100 may consist of a peripheral portion of flexible support type formed by a C-shaped strip or blade and of a solid central portion made of flexible material or foamy as mentioned in the preceding examples and alternative embodiments.

The strip or blade may for example be made of spring steel or plastic material and be covered with a material such as leather, fabric or else synthetic material.

The two portions can then be assembled and held together by gluing or else be removable from one another.

Figure 7:
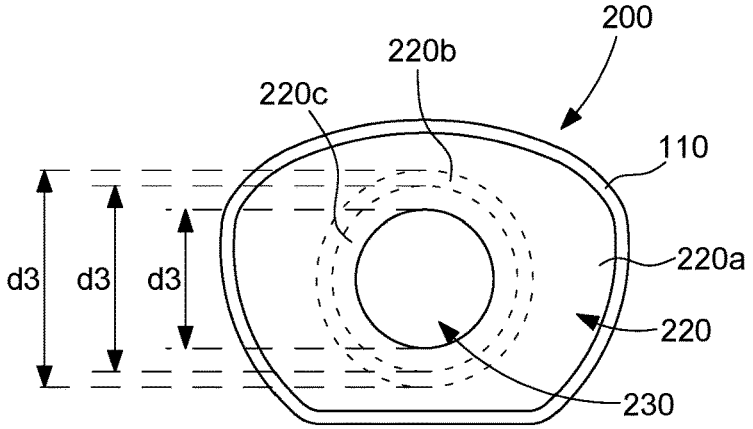
FIG. 7 illustrates a side view of a second exemplary embodiment of a support element according to the invention.

FIG. 7 illustrates a second embodiment of a support element 200 according to the invention. This second exemplary embodiment is identical to the first exemplary embodiment as well as to the various alternative embodiments mentioned with the exception of the features which will be described below.

In this second embodiment, the central portion 220 of the support element 200 is formed by the combination of different portions 220*a*, 220*b*, 220*c* formed on the periphery of the internal cavity 130, extending concentrically, or not, along the axis X-X of the internal cavity 230.

In this second exemplary embodiment, two removable portions 220*b*, 220*c* were shown. These removable portions 220*b*, 220*c* allow the shape and/or dimensions of the internal cavity 230 of the support element 200 to be modulated when removing the removable portions.

It is clear that the shape and the external dimensions of the removable portions define the shape and the dimensions of the internal cavity 130 during the removal of said removable portion in question.

For example, when the removable portions 220*b*, 220*c* are in position, the internal cavity 230 has a circular section of constant size along the axis X-X of diameter d3. When the first removable portion 220*c* is removed, the central portion 220 may have different dimensions and/or shapes. In the exemplary embodiment, the internal cavity 230 has a constant section of circular shape and of diameter d1, d1 being greater than d3.

When the second removable portion 220*b* is in turn removed, it is possible to again modify the shape and dimensions of the internal cavity 130. The configuration already described in FIGS. 2 and 3, with an internal cavity 130 in the shape of a counterbore having a first diameter d1 and a second diameter d2 can then be obtained.

The removable portions 220*b*, 220*c* are preferably made of the same material as the remaining portion 220*a* of the central portion 220.

Identically to the first embodiment described above, the entire central portion 220 is made of a flexible material having elastic or viscoelastic properties. Thus, the central portion 220 can be made of polymer foam, an elastomer, of viscoelastic polymer, etc. . . . .

As an example, the flexible material is, for example, a polyurethane foam or a polyethylene foam.

Identically to the first embodiment, the various removable portions 220*b*, 220*c* are held in position by friction or by elastic or viscoelastic response of the material.

Figure 8:
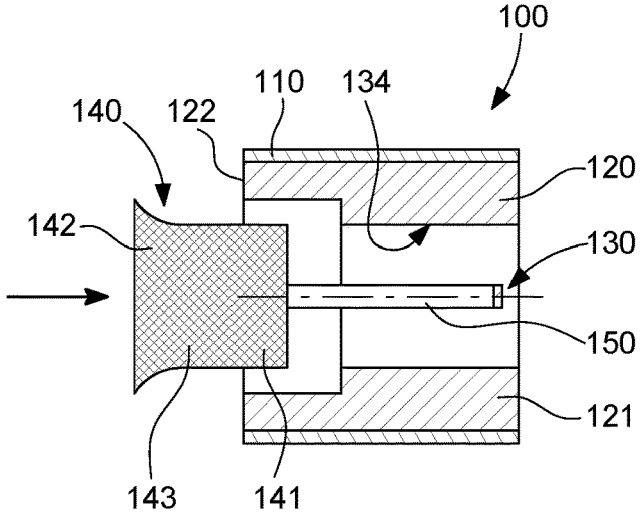
FIG. 8 illustrates the introduction of an accessory inside the internal cavity of the first exemplary embodiment of the support element illustrated in FIG. 1, the support element being shown in section relative to the section plane A-A illustrated in FIG. 2.
Figure 9:
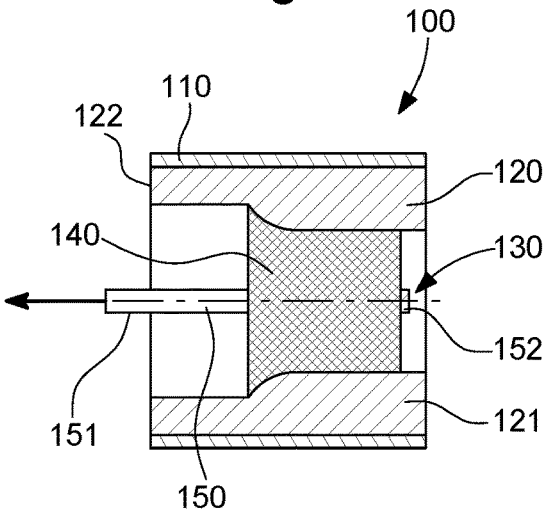
FIG. 9 illustrates the accessory housed inside the internal cavity of the first exemplary embodiment of the support element illustrated in FIG. 1, the support element being shown in section relative to the section plane A-A illustrated in FIG. 2.

FIGS. 8 and 9 show an example of insertion of an accessory 140 in the support element 100 according to the invention, as described and shown with reference to FIGS. 1 to 3.

The accessory 140 shown by way of example is a magnifying device, such as a watchmaker's eyeglass, which may have a flared collar 143 at one of these ends.

The counterbore shape of the internal cavity 130 described with reference to FIG. 3 is particularly well adapted to the insertion and retention of such a magnifying device having a flared collar at one of these ends.

Thus, as shown in FIG. 8, the placement of such an accessory 140 is achieved by the introduction of a first end 141, opposite to a second end 142 having the flared collar 143, at the portion of the internal cavity 130 having the largest diameter d1.

The accessory 140 is introduced inside the internal cavity 130 by translation along the axis X-X until it abuts with the annular shoulder 133. The material of the central portion 120 being advantageously flexible and deformable, it is possible to slightly continue the introduction of the accessory inside the internal cavity 130 by elastically deforming the radially internal portion of the annular shoulder 133. The retention of the accessory 140 being achieved by elastic or viscoelastic response of the material at the annular shoulder 133 and/or at the wall 134 of the internal cavity 133, thus clamping the accessory 140.

To promote the removal of the accessory 140 in position inside the internal cavity 130, the support element 100 may comprise a removal member 150 configured to allow the sliding and removal of the accessory 140 outside the internal cavity 130. Such a member 150 allows to prevent the user from pressing directly on the accessory 140 to remove it. Thus, this eliminates finger marks, scratches that can be generated on the accessory 140 during this removal operation.

The removal member 150 is for example a pull tab having one end 151 easily grabbed by use and one end 152 in contact with the accessory 140 when the latter is inside the internal cavity 130. By pulling on the end 151 of the removal member 150, the user initiates the removal of the accessory 140 in the direction opposite to the direction of introduction by moving at least part of the end 152, which then facilitates the gripping of the accessory and its complete removal.

Figure 10:
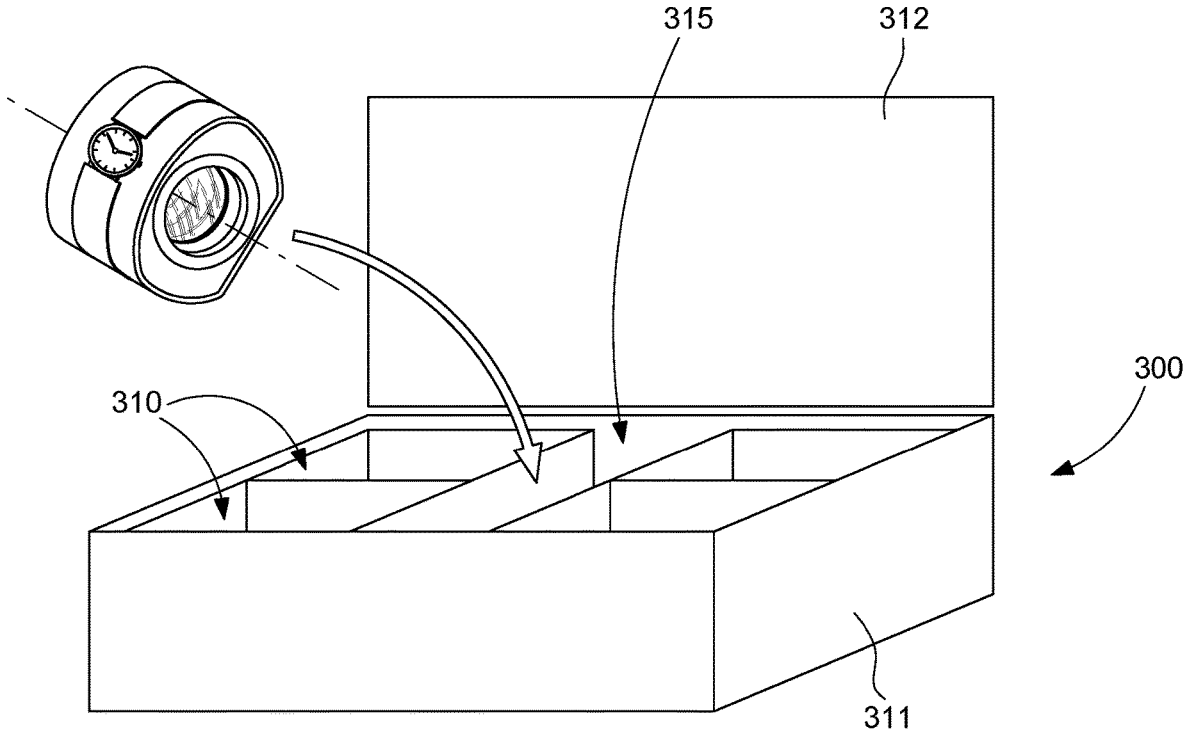
FIG. 10 is a schematic perspective representation of a storage member intended to receive a support element according to the invention.

FIG. 10 schematically shows a storage member 300 intended to receive a support element 100, 200 according to the invention.

The storage member 300 is for example a box having an external envelope 311 of rigid design, for example made of compact cardboard, or of wood, and having a movable portion 312, for example a cover, movable between a closed position and an open position allowing access to the interior of the storage member 300.

The storage member 300 has at least a first compartment 315 configured to receive the support element 100, 200 according to the invention described above.

The storage member 300 may also comprise at least a second compartment 310 allowing the positioning of additional accessories.

The invention claimed is:

1. A support element for a timepiece or a piece of jewelry, the support element including:

a receiving surface configured to be at least partly in direct contact with said timepiece or the piece of jewelry;

a peripheral portion carrying said receiving surface;

a central portion comprising openings through a block of material having a stepped portion between the openings, the stepped portion being of the support element and comprising flanks each being substantially planar and parallel to each other; and an internal cavity forming a recess in the central portion, wherein said internal cavity defines a volume configured to receive and hold in position an object inside said support element, wherein, in a radial direction of the support element, a thickness of the block of material of the central portion is greater than a thickness of the peripheral portion, wherein the block of material is terminated at the openings, wherein the stepped portion is within a cavity of the block of material, wherein the cavity is between the openings, and wherein the flanks are extended from within the cavity and to the openings.

2. The support element according to claim 1, wherein the central portion comprises at least one region made of cellular material, elastomer or else viscoelastic polymer, said internal cavity being located at said region made of cellular material, elastomer or else viscoelastic polymer.

3. The support element according to claim 1, wherein the central portion comprises at least one region made of polyurethane foam or polyethylene foam, said internal cavity being located at said region made of polyurethane foam or polyethylene foam.

4. The support element according to claim 2, wherein said object is retained in said internal cavity by elastic or viscoelastic response of the material after a deformation of the internal cavity.

5. The support element according to claim 1, wherein the central portion has a density comprised between 30 and 90 Shore A.

6. The support element according to claim 1, wherein the peripheral portion is made of cellular material, elastomer or else viscoelastic polymer.

7. The support element according to claim 1, wherein the peripheral portion and the central portion are formed integrally.

8. The support element according to claim 1, wherein said internal cavity extends on either side of said central portion.

9. The support element according to claim 1, wherein said internal cavity defines a volume configured to receive and hold in position a timepiece accessory or a piece of jewelry inside said support element.

10. The support element according to claim 9, wherein the timepiece accessory is a magnifying device.

11. The support element according to claim 1, wherein said internal cavity has the shape of a counterbore.

12. The support element according to claim 1, wherein said support element comprises a removal member configured to allow the object to be removed from the internal cavity.

13. The support element according to claim 1, wherein the central portion comprises at least one removable portion formed at the periphery of said internal cavity, said removable portion being configured to modify the shape and/or the dimensions of said internal cavity upon removal of said removable portion from the central portion.

14. The support element according to claim 1, wherein the support element has a shape adapted to receive a wristwatch at said receiving surface.

15. An organ for storing a timepiece or a piece of jewelry, the organ comprising:

an external envelope including a movable portion movable between a closed position and an open position, said open position of the movable element allowing access to an internal compartment formed inside the external envelope;

a support element according to claim 1 removably positioned in said internal compartment.

16. The support element according to claim 1, wherein the block of material of the central portion is attached to an inner periphery of the peripheral portion.

* * * * *